United States Patent [19]

Tacq et al.

[11] Patent Number: 4,964,442

[45] Date of Patent: Oct. 23, 1990

[54] RESERVE WEFT THREAD SUPPLY MECHANISM WITH DEVICE FOR CHANGING THREAD TYPE

[75] Inventors: Jo Tacq, Ieper; Roger Ligneel, Beselare; Henry Shaw, Vleteren, all of Belgium

[73] Assignee: Picanol N.V., Belgium

[21] Appl. No.: 366,622

[22] Filed: Jun. 16, 1989

[30] Foreign Application Priority Data

Jun. 17, 1988 [BE] Belgium ..... 08800687

[51] Int. Cl.[5] ..... D03D 47/30; D03D 47/36

[52] U.S. Cl. ..... 139/452; 139/453

[58] Field of Search ..... 112/435, 450, 452, 453

[56] References Cited

U.S. PATENT DOCUMENTS

| | | | |
|---|---|---|---|
| 4,673,004 | 6/1987 | Rosseel et al. | 139/435 |
| 4,815,501 | 3/1989 | Takehana | 139/450 X |
| 4,832,086 | 5/1989 | Shin et al. | 139/435 |
| 4,832,091 | 5/1989 | Shaw | 139/452 X |

FOREIGN PATENT DOCUMENTS

| | | |
|---|---|---|
| 0195469 | 9/1986 | European Pat. Off. . |
| 0269140 | 6/1988 | European Pat. Off. . |

*Primary Examiner*—Andrew M. Falik

*Attorney, Agent, or Firm*—Bacon & Thomas

[57] ABSTRACT

A mechanism for supplying weft thread to the shed of a weaving machine includes at least three different weft supply mechanisms, at least one of which is arranged to operate with at least two different weft thread sources for the purpose of acting as a reserve thread supply for either of the first two weft thread supply mechanisms.

15 Claims, 5 Drawing Sheets

1
7
6A
15
6B
8
6C
9
10
14
3
6A
11
6B
4
12
6C
5
2
37
39
41
13
42

1
7
6A
15
6B
8
6C
9
10
14
3
6A
11
6B
16
4
12
6C
5
2
37
39
41
13
42

7
6A
35
25
23
8
6B
24
1
6C
36
22
15
2
9
37
39
25
10
23
3
17
47
6A
6B
6A
44
24
18
48
22
19
46
40
25
41
13
23
4
20
6B
11
24
22
25
5
23

1
2
3
4
5
7
8
9
10
11
12
13
14
15
16
17
18
19
20
21
22
23
24
25
26
27
28
29
30
31
32
33
34
35
36
37
38
39
40
41
42
43
Q
6A
6B
6C

RESERVE WEFT THREAD SUPPLY MECHANISM WITH DEVICE FOR CHANGING THREAD TYPE

BACKGROUND OF THE INVENTION

This invention concerns a mechanism and a method for supplying weft threads on weaving machines.

As is generally known, on weaving machines the weft threads are supplied to the shed by first winding them off yarn packages or the like by means of thread supply mechanisms and then inserting them into the shed. These thread supply mechanisms include prewinders formed by drums on which a quantity of thread is wound, so that a number of turns can be drawn off at each weaving cycle, thereby providing the required length of weft thread per insertion. The thread supply mechanisms also include insertion mechanisms for inserting the drawn off lengths of weft thread one by one into the shed. When making a cloth which contains different kinds of weft thread, for example weft threads of different colors or weft threads of different types, it is known to use at least as many weft supply mechanisms as there are used different kinds of weft threads.

On modern weaving machines, the aim is to automate them as far as possible in order to avoid weaving machine stops or to reduce stops to a minimum. In order to limit weaving machine stops due to faults in the weft thread supply, it is known from Belgian patent No. 901.969 held by the present applicant to hold a reserve mechanism in readiness for each weft supply mechanism. When a fault in the supply of a weft thread occurs, the machine automatically switches over to the reserve mechanism with the same type of weft thread. Although machine stops can be avoided with this known mechanism, it has the disadvantage that the weft supply mechanisms must be duplicated, so that the weaving machine is bulkier and also considerably more expensive than a conventional weaving machine.

SUMMARY OF THE INVENTION

The present invention concerns a mechanism for the supply of weft threads which does not have the abovementioned disadvantages. To this end, the invention concerns a mechanism which includes at least three weft supply mechanisms, at least one of which operates with at least two thread supplies for different types of weft thread. The mechanism also includes a device by which the weft supply mechanism which works with the different types of weft thread can be supplied with one of the weft threads according to choice, as well as a control unit which controls the device.

Use of the mechanism according to the invention makes it possible for a weft supply mechanism which operates with several types of weft threads to be fed with the same types of weft thread as are being woven during the normal weaving process. The weft supply mechanism is kept on standby as a reserve mechanism, and is activated whenever a fault in the supply of one of the weft threads normally used occurs. At that moment the weft supply mechanism placed on standby is provided with the same sort of thread as the weft supply mechanism in which the fault occurs. Clearly, this means that it is only necessary to have one reserve weft supply mechanism, which can replace any of the other weft supply mechanisms which are normally in use.

The invention also concerns a method for supplying weft threads on weaving machines in which different weft threads are inserted successively into the shed in a particular pattern, including the steps of supplying the different weft threads during the normal weaving process via respective weft supply mechanisms and, during the normal weaving process, holding on standby at least one weft thread supply mechanism which operates with different thread supplies, the thread supplies containing at least the same types of weft thread as are being woven during the normal weaving process. When faults in the supply of the weft threads during the normal weaving process are detected the weft supply mechanism in which the fault has occurred is switched over to the weft supply mechanism on standby. The standby weft supply mechanism is then fed with weft thread of the same type as the weft thread in which the fault has occurred.

BRIEF DESCRIPTION OF THE DRAWINGS

In order to better explain the invention, the following preferred embodiments are described below, by way of example only and without being limitative in any way, with reference to the accompanying drawings, where.

DESCRIPTION OF THE PREFERRED EMBODIMENTS

Figure 1:
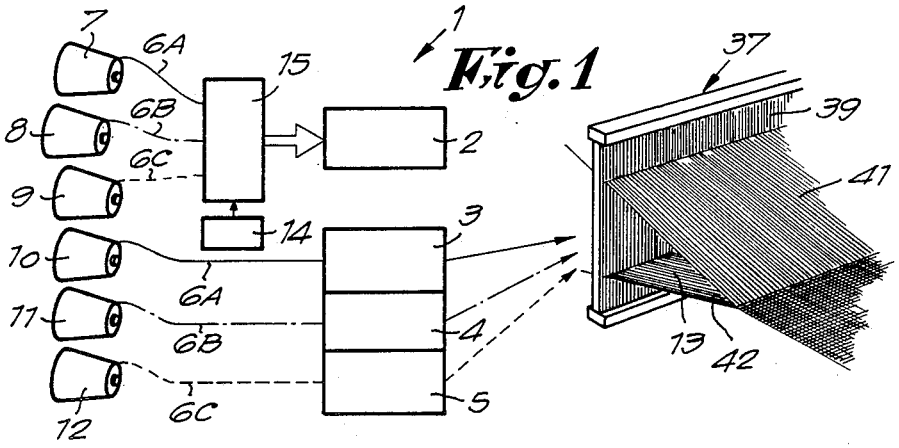
FIG. 1 is a schematic diagram of the mechanism according to the invention, in which the weft supply mechanism which operates simultaneously with several weft threads is kept on standby.

As shown in FIG. 1, the mechanism 1 according to the invention includes a plurality of weft supply mechanisms 2 to 5, in which different sorts of weft threads, 6A, 6B and 6C respectively, can be drawn from thread supplies 7 to 12, for example yarn packages, in order for lengths of the different types of weft thread to be inserted one by one into the shed 13 of the weaving machine, in a known way according to the weave pattern.

Figure 2:
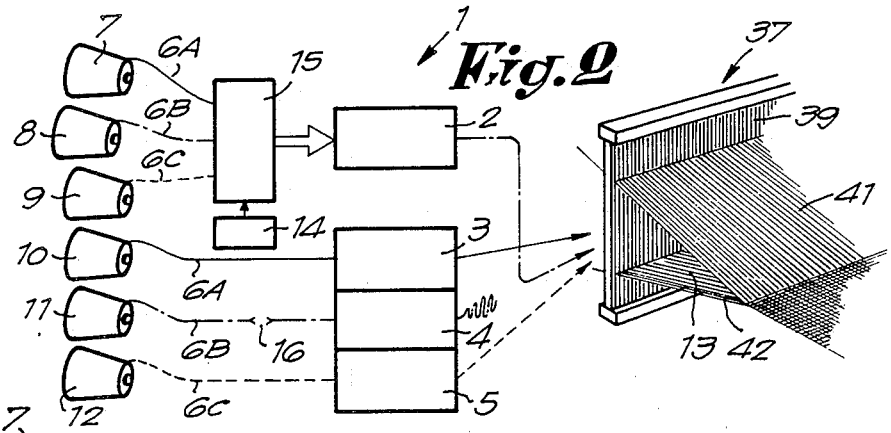
FIG. 2 is a schematic diagram of the mechanism shown in FIG. 1, at the moment that a fault in the normal supply of the weft threads occurs, at which time the weft supply mechanism which operates with several thread supplies is put into operation.

At least one of the weft supply mechanisms—weft thread supply mechanism 2 in FIGS. 1 and 2—operates with several thread supplies 7 to 9 with different sorts of weft thread 6A, 6B and 6C. Further, use is made of a device 15, controlled by a control unit 14 in order to supply according to choice one of the weft threads 6A, 6B or 6C from the thread supplies 7 to 9 to the corresponding weft thread supply mechanism 2.

In a preferred embodiment of the invention, the mechanism 1 enables a preferred method to be used for supplying the different types of weft thread. As shown in FIG. 1, during the normal weaving process the different types of weft thread 6A, 6B and 6C are inserted into the shed 13 according to a particular pattern, such that each is supplied via its own weft supply mechanism, 3 to 5 respectively, while weft supply mechanism 2 is kept on standby until it is needed, whereupon it operates with the same types of weft thread 6A to 6C, drawn from the thread supplies 7 to 9.

When a particular fault occurs in the supply of one of the weft threads 6A to 6C coming from the thread supplies 10 to 12, the corresponding weft supply mechanism is deactivated and the weft thread supply mechanism 2 is activated to replace the deactivated supply mechanism, such that by means of the device 15 mechanism 2 is supplied with the same type of weft threads 6A, 6B or 6C as the mechanism in which the fault has occurred. Such a fault can for instance consist of a thread break or the fact that one of the thread supplies has run out. FIG. 2 is a schematic diagram of an example in which a fault 16, for example a thread break, has occurred in the supply of the weft thread 6B coming from thread supply 11. As a result of this fault being detected, control unit 14 can control the device 15 in such a way that the weft thread 6B from the thread supply 8 is supplied to the weft supply mechanism 2, which is then activated to replace the weft supply mechanism 4 until, for example thread break 16 has been repaired.

The particular configuration of the mechanism 1 according to FIGS. 1 and 2 and the method used here offer the advantage that only one weft supply mechanism 2 is needed to supply any of the reserve weft threads 6A, 6B or 6C.

Figure 3:
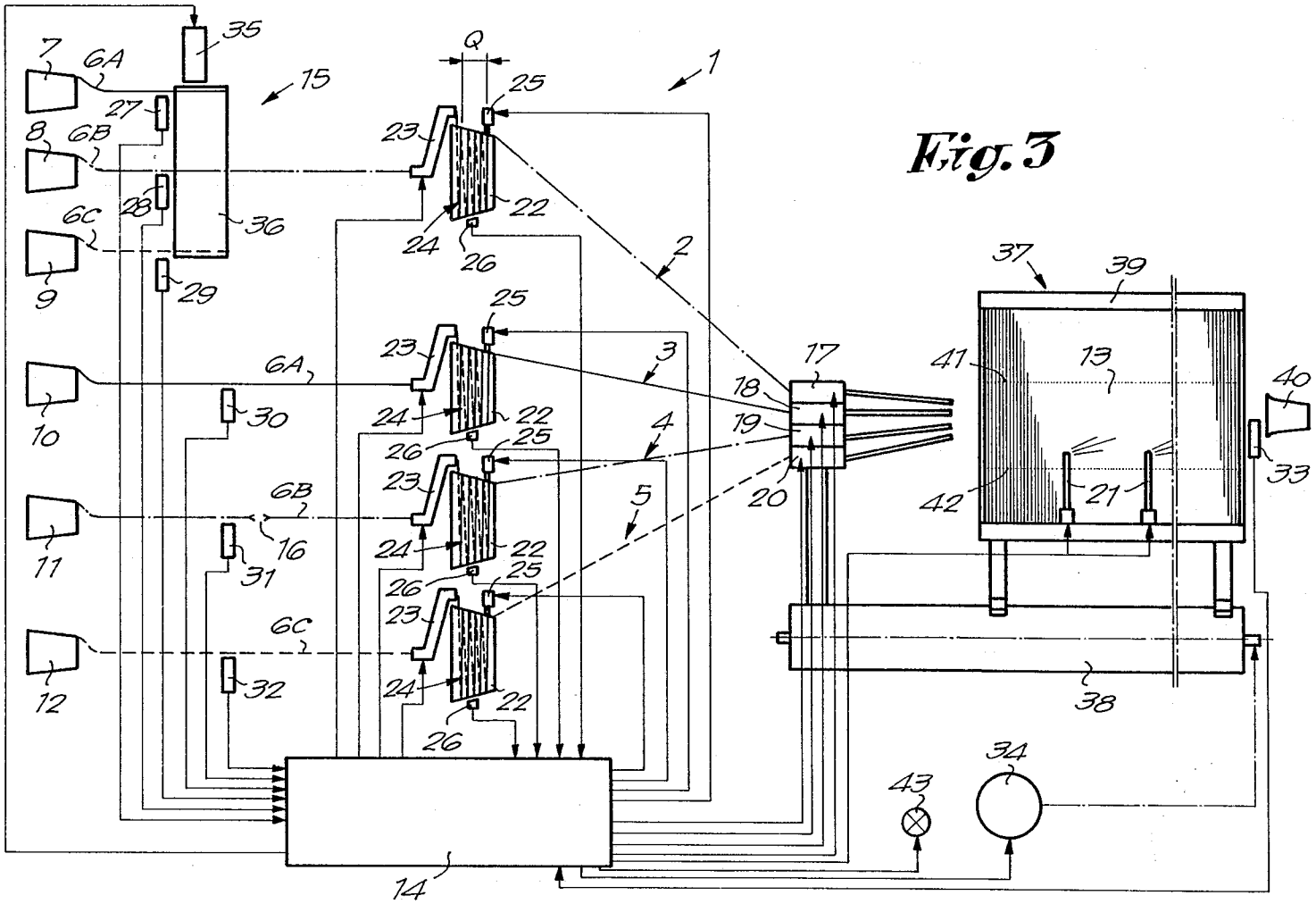
FIG. 3 shows a practical embodiment of the mechanism according to FIG. 1, used on an airjet weaving machine.

FIG. 3 shows a practical embodiment of the mechanism 1, for an airjet weaving machine. Here, the weft threads 6A to 6C are inserted into the shed 13 by means of main nozzles 17 to 20 and a number of relay nozzles 21.

The above-mentioned weft supply mechanisms 2 to 5 in this case use prewinders which each include a prewinder drum 22, a rotating winding tube 23 for winding a predetermined number of turns 24 on the prewinder drum 22, an electromagnetic retaining mechanism 25 which acts on the surface of the prewinder drum 22, and one or more turn detectors 26 positioned along the winding drum 22, together with the insertion mechanism formed by the above-mentioned main nozzles 17 to 20.

The control unit 14 is connected to plurality of thread break detectors 27 to 32, for example thread motion detectors which are positioned along the path of the weft threads 6A to 6C from the respective thread supplies 7 to 12. The control unit 14 is also to weft stop motion 33 mounted in the conventional manner at the far side of the shed 13, and to the above-mentioned turn detectors 26. Control unit 14 controls the activation and deactivation of a number of components, including the main nozzles 17 to 20, the drives of the winding tubes 23, the retaining mechanism 25, the relay nozzles 21, the main drive 34 of the weaving machine and the above-mentioned device 15.

The above-mentioned device 15 includes an apparatus 35 for tying the weaving threads and a device 36 for holding the different weft threads 6A, 6B and 6C from the thread supplies 7 to 9 and presenting them to each other. The apparatus 35 can be a tying apparatus which itself is known, or a splicing unit. The device 36 can be made up of a number of mobile thread clips and thread eyes such that two of the threads, 6A, 6B or 6C according to choice, can always be presented to each other. Since such a device 36 can be made up in various ways and is within the scope of any person skilled in the art, for the sake of clarity it is only shown schematically in the figures.

Finally, also shown in FIG. 3 are the sley 37, including batten beam 38 and reed 39 mounted on batten beam, a suction nozzle 40 at the far side of the shed 13, the upper warp sheet 41 and the lower warp sheet 42.

The operation of the mechanism and the method by which it is preferably used are now described with reference to FIGS. 3 to 6. FIG. 3 shows the same condition as in the schematic diagram in FIG. 2. As can be seen, the thread break 16 has been detected by the detector 31. As a result, weft supply mechanism 4 is deactivated by means of the control unit 14. Weft supply mechanism 2 is activated in its place. If as shown in FIG. 3 the same type of weft thread 6B is still present in the weft supply mechanism 2 as in the weft supply mechanism in which the thread break 16 has occurred, then weaving can continue immediately from thread supply 8, without a weaving machine stop. A minimum quantity of weft thread Q, corresponding to one pick length to be inserted into the shed 13, is always kept on the prewinder drum 22 of the weft supply mechanism on standby.

Clearly, the control unit 14 can activate a signalling device 43 in order to warn the weaver that a repair needs to be carried out. In the case where a second thread break occurs before the first has been repaired, the weaving machine will come to a stop.

Figure 4:
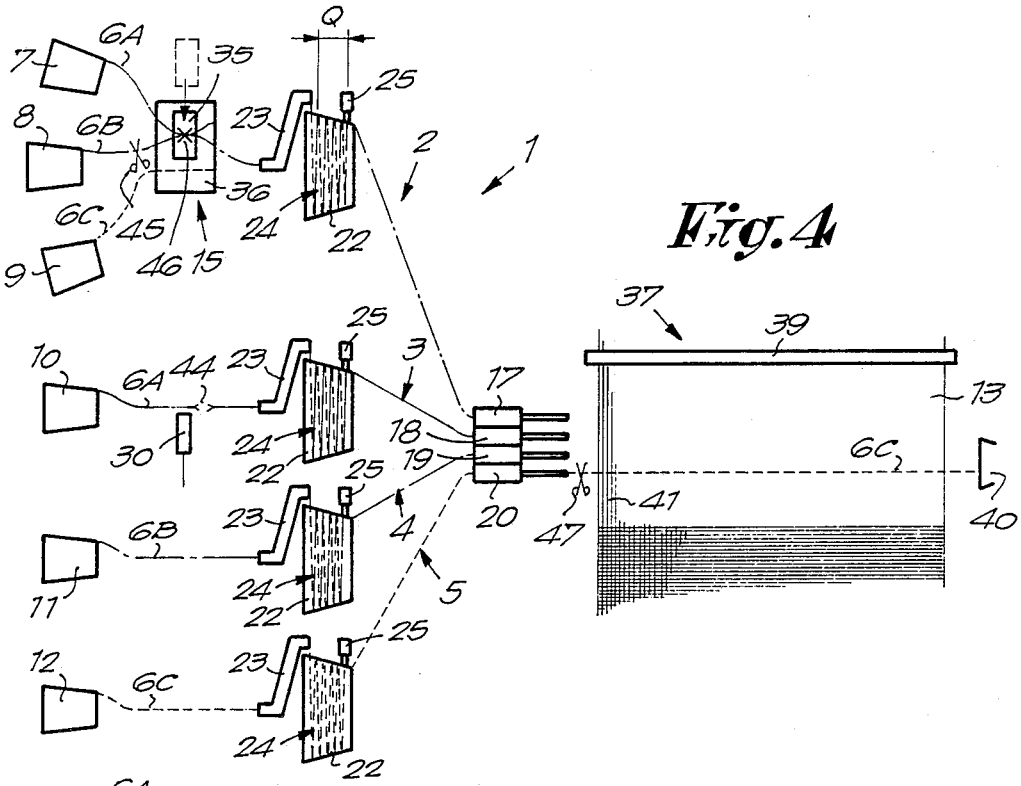

In the case shown in FIG. 4, a thread break 44 is present in a weft thread 6A which is different in, type or color from the weft thread 6B present in the weft supply mechanism 2 on standby. When the thread break detector 30 detects the fault, the above-mentioned device 15 comes into operation and the end of the weft thread 6A from the reserve thread supply 7 is presented to the weft thread 6B which is present in the weft supply mechanism 2. Weft thread 6A is then joined to weft thread 6B by the apparatus 35, which itself is provided with the necessary cutting device 45 in order to cut the thread supply 8 loose, to form join 46 join 46 consists for example of a knot. If the weaving pattern permits, the weaving machine can continue working in the meantime, so that other weft threads are inserted into the shed 13, for example weft thread 6C from thread supply 12.

Figure 5:
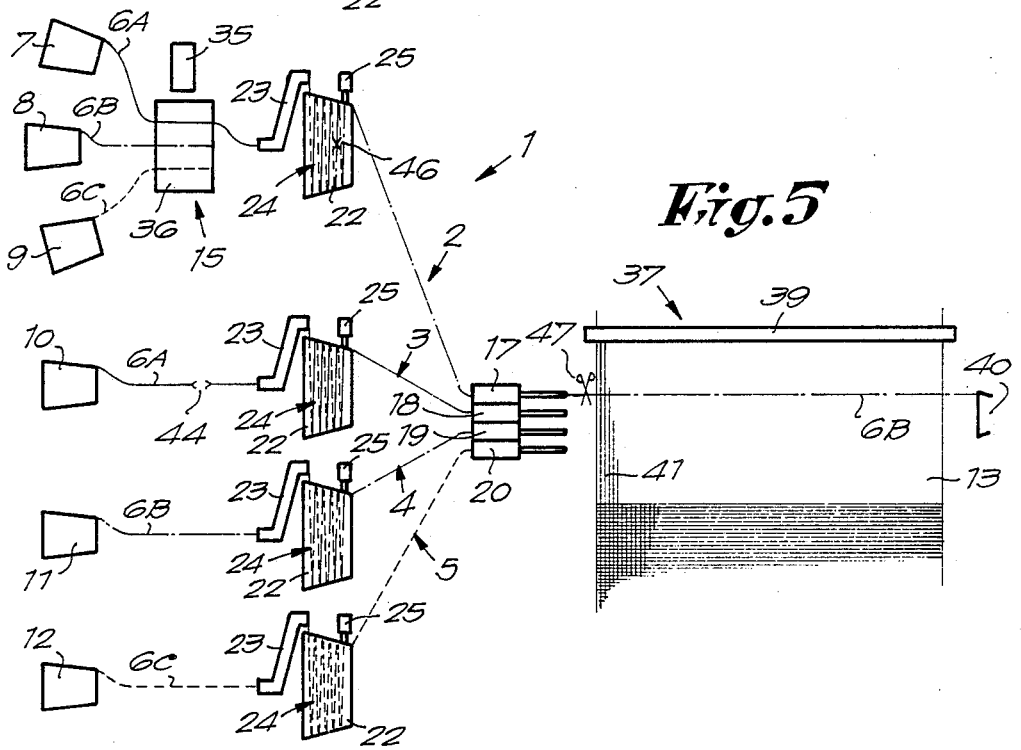

Once the join 46 has been made, a certain quantity of weft thread 6A from the thread supply 7 is already wound on the prewinder drum 22 of the weft supply mechanism 2, as shown in FIG. 5. If the weaving pattern permits, then preferably one more length of weft thread 6B present in weft supply mechanism 2 is released from the prewinder drum 22, inserted into the shed 13 in the normal way and cut off by means of the weft cutter 47. In this way, any remaining quantity of weft thread 6B in weft supply mechanism 2 is kept to a minimum.

Figure 6:
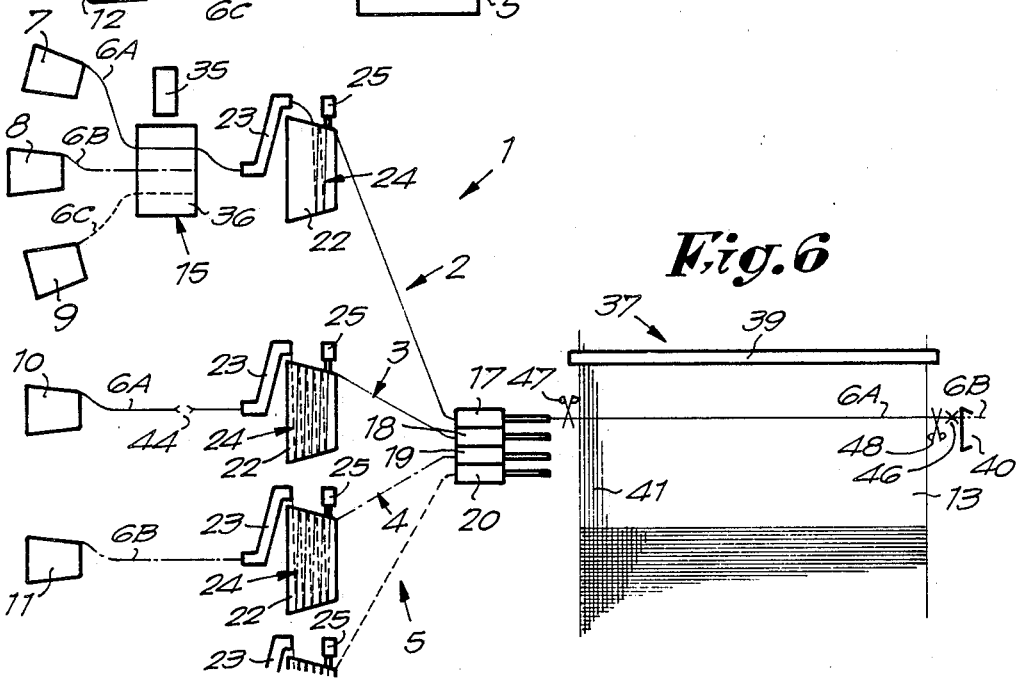
FIGS. 4 to 6 show the mechanism according to FIG. 3 in various conditions.

Subsequently, when a length of weft thread 6A has to be inserted into the shed 13, then as shown in FIG. 6 the retaining mechanism 25 of the weft supply mechanism 2 is opened sufficiently long to release at least enough turns 24 for the join 46 to reach the far side of the shed 13 opposite the main nozzles. The above-mentioned remaining part of the weft thread 6B is sucked up into the suction nozzle 40 and cut off at the far side of the shed 13 by a cutting device, for instance a cutter 48. Clearly, for this to be done a large quantity of weft thread, consisting of part of the weft thread 6B and a complete length of the weft thread 6A, must be led through the shed 13, so that as a consequence more time will be required than for a normal pick. In order to allow for this the main drive 34 of the weaving machine can be halted briefly, or can be set to a lower speed. If however as in FIG. 5 the weaving pattern does not permit the quantity Q of the weft thread 6B to also be inserted into the shed before the weft thread 6A is demanded, then quantity Q must first be led in its entirety through the shed 13, which of course will make a slightly longer machine stop necessary.

In a variant of the method according to the invention, the above-mentioned join 46 is made between the thread preparation mechanism and the component which inserts the thread into the shed 13, i.e. in the case of an airjet weaving machine between the prewinder drum 22 and the main nozzle 17. The quantity of weft thread present in the weft supply mechanism 2 placed on standby is then wound off the corresponding prewinder drum 22 and cut off. In this way the quantity of thread which has to be led the whole way through the shed 13 is kept to a minimum. In order to achieve this, the mechanism 1 includes a device 15 which, as shown in FIGS. 7 to 10, includes a rotating package frame 49 on which the above-mentioned yarn packages 7 to 9 are mounted, the respective weft threads 6A to 6B being through nozzles 50 and 52. The device 15 also includes a cutter 53 mounted before the weft supply mechanism 2, a device 54 to remove the weft thread present in the weft supply mechanism 2—or at least the part present on the prewinder drum 22, and the above-mentioned apparatus 35 for joining weft threads. The device 54 includes a suction nozzle 55 mounted in the path of the reserve weft thread, as well as a transversely-oriented suction nozzle 56. In addition there are a number of thread clips 57 to 61, together with cutters 62 which operate in conjunction with the suction nozzle 56. The prewinder used is of the type which can be automatically rethreaded pneumatically.

Figure 7:
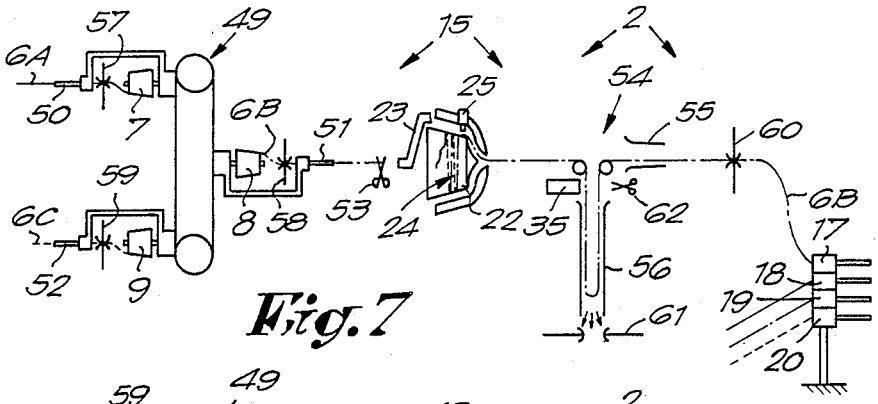
FIG. 7 shows another practical embodiment of the invention.

The operation of the mechanism can be simply deduced from FIGS. 7 to 10. In FIG. 7 the same situation applies as in FIG. 4. The weft supply mechanisms 3 to 5 have been omitted to better show the remaining elements, but their arrangement is the same as that shown in FIG. 4.

In FIG. 7, the weft thread 6B is cut by means of a cutter 53 at a short distance after the nozzle 51. The retaining mechanism 25 of the weft supply mechanism 2 is opened while the suction nozzle 56 is in operation. As a result the quantity of weft thread 6B present on the prewinder drum 22 is entirely sucked up into the suction nozzle 56. Clearly, in so doing the thread clip 60 must be kept closed in order to prevent the weft thread 6B from being pulled out of the main nozzle 17.

Figure 8:
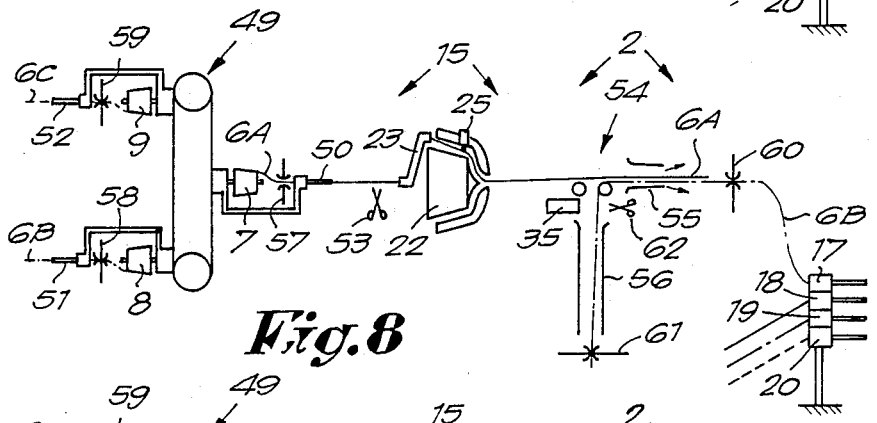
FIGS. 8 to 10 show the different conditions of the invention according to FIG. 7.

The package frame 49 is then rotated, such that the nozzle with the correct sort of weft thread, in this case nozzle 50 with weft thread 6A, is presented precisely at the intake of the winding tube 23 of the weft supply mechanism 2. As shown in FIG. 8, by activating the nozzle 50 the weft thread 6A is led into the winding tube 23 and along the prewinder drum 22 of the weft supply mechanism 2, and taken up by the suction nozzle 55. The thread clip 57 is subsequently closed. Clearly, during this stage the suction nozzle 56 is deactivated and the thread clip 61 is kept closed.

Figure 9:
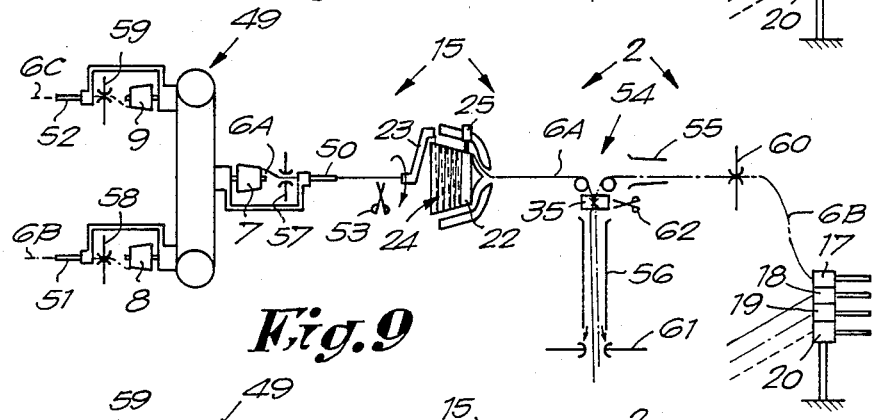

In the next step, the suction nozzle 56 is activated once more, such that both types of weft thread 6A and 6B are sucked up by their ends and can be joined together by means of the apparatus 35, as shown in FIG. 9. To make the join, the free ends are cut off by the cutter 62 and removed by the suction nozzle 56, in the normal way. In the meantime the retaining mechanism 25 is closed once more and a quantity of the weft thread 6A is built up in the weft supply mechanism 2, after the thread clip 57 has been opened once more.

Figure 10:
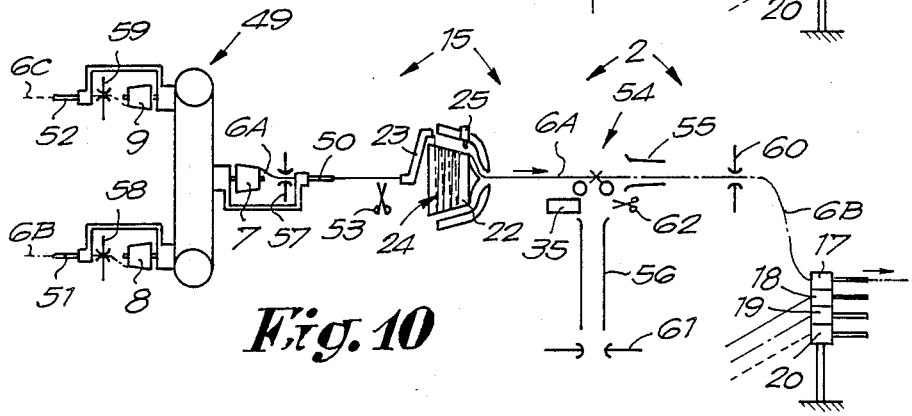

Finally a state is reached as shown in FIG. 10, from which it can be seen that at the moment a quantity of weft thread 6A has to be inserted into the shed 13, the remaining length of weft thread 6B which has to be led through the whole width of the shed is very small, so that it is not always necessary for the weaving machine to be stopped in order to do this.

According to a variant of the invention, in the case where a thread break 44 occurs in a weft thread 6A which is different from the weft thread 6B present in the weft supply mechanism 2 on standby—i.e. a situation analogous to that shown in FIG. 7—the weaving machine is brought to a halt, the thread 6B is cut by the cutter 53 and the quantity of weft thread 6B remaining in the weft supply mechanism 2 is blown into the suction nozzle 40 by means of the main nozzle 17 and relay nozzles 21 until it has been removed completely. The package frame 49 is then rotated until the nozzle 50 for the correct type of weft thread 6A is presented precisely at the intake of the winding tube 23 of the weft supply mechanism 2, as shown in FIG. 8. By means of the nozzle 50, the weft thread 6A is then led into the winding tube 23, along the prewinder drum 22, through the suction nozzle 55 and into the main nozzle 17 whereupon the weft thread 6A is brought into the suction nozzle 40 by means of the main nozzle 17 and the relay nozzles 21. The corresponding retaining mechanism 25 is closed and a certain number of turns 24 are laid on the prewinder drum 22 by means of the winding tube 23. The section of weft thread present in the shed is then cut off by the weft cutter 47 and removed by means of the suction nozzle 40. The weaving machine is then started, after which the supply of the weft thread 6A is ensured by the weft supply mechanism 2. Using the nozzles 50, 51 and 52 offers the advantage that the threads 6A, 6B and 6C can be presented directly at the intake of the winding tube 23 of the weft supply mechanism 2, thus enabling rapid rethreading of this mechanism.

Figure 11:
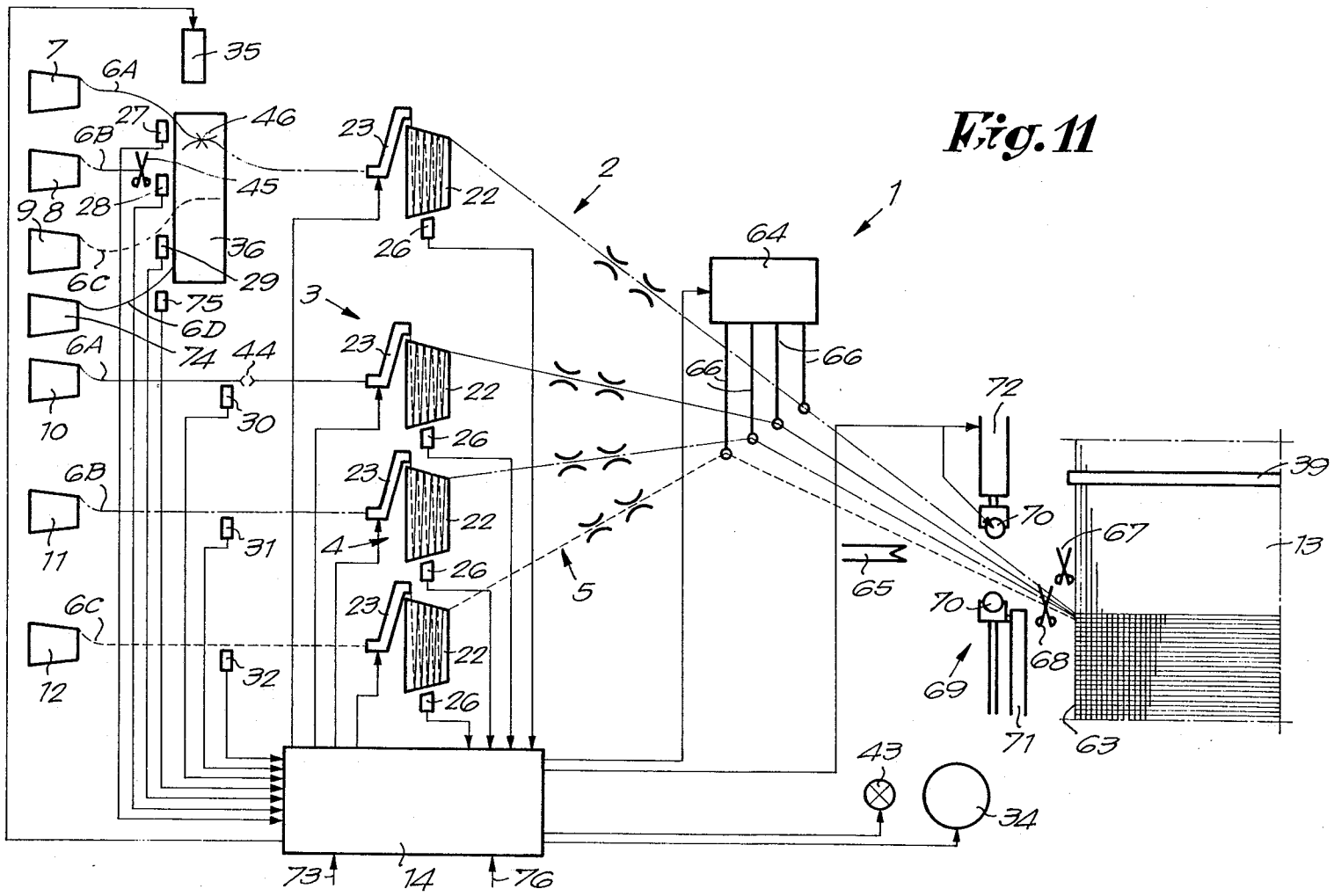
FIG. 11 shows a practical embodiment of the mechanism according to FIG. 1 on a rapier weaving machine.

Obviously, the above-mentioned weft supply mechanism 2 which is kept on standby is not necessarily inactive. It is always possible for the weft supply mechanism 2 to be used alternately with one of the other weft supply mechanisms 3 or 5, in order to ensure the supply of the same sort of weft thread during the normal weaving process. In the embodiment shown in FIG. 4, this means for example that the weft thread 6B is inserted into the shed 13 via weft supply mechanisms 2 and 4 alternately. If the thread break occurs in the weft thread 6B of the weft supply mechanism 4, weft thread 6B continues to be supplied by weft supply mechanism 2 only. If on the other hand a thread break 44 occurs in one of the weft threads 6A or 6C, then weft thread 6B is supplied via weft supply mechanism 4 only, while weft supply mechanism 2 is used to ensure the supply of the sort of weft thread 6A or 6C in which the break 44 has occurred. The invention is not limited to airjet weaving machines. To illustrate this, FIG. 11 shows a mechanism 1 according to the invention which is intended in particular for rapier weaving machines of the type in which the weft threads after being inserted remain connected to the edge of the cloth 63. As is known, in this type of weaving machine the weft threads 6A to 6C are presented in the path of a gripper 65 by means of a thread presentation mechanism 64, such that they are inserted into the shed 13. In this case, each of the above-mentioned weft supply mechanisms 2 to 5 includes a prewinder, formed by a prewinder drum 22 and a winding tube 23, and a thread presentation element 66. Also shown in FIG. 11 are the weft cutter 67, a cutting device 68 which can cut off all hanging weft threads along the edge 63 of the cloth, and a thread removing mechanism 69 including driven thread removing rollers 70 and a suction nozzle 71. The rollers 70 are mounted along the weft threads 6A to 6B and can be moved towards each other by means of a positioning mechanism 72.

FIG. 11 shows a similar situation to that in FIG. 4 in which the join 46 has already been made. Subsequently the thread removing mechanism 69 is activated, such that all the weft threads held by the thread presentation mechanism 64 are gripped between the rollers 70 and carried towards the suction nozzle 71. The thread removing mechanism 69 continues to operate until it is certain that the join 46 has been sucked up into the suction nozzle 71, and preferably also until all the weft thread 6A present in the weft supply mechanism 3 has also been sucked up into the suction nozzle 71. At the same time, all weft threads are cut off from the cloth edge 63 by means of the cutting device 68. When the join 46 has been drawn past the rollers 70, the rollers 70 are moved apart once more and weaving can start again, with the weft threads 6A, 6B and 6C being supplied via the weft supply mechanisms 2, 4 and 5 respectively. As soon as all three weft threads hanging from the thread presentation mechanism 64 into the suction nozzle 71 have been inserted into the shed 13 once, they are all cut off at the beginning of the insertion, which means that the thread waste can be completely sucked up into the suction nozzle 71.

In yet another variant of the above-mentioned method, only the weft thread coming from the weft supply mechanism 2 which operates with several thread supplies 7, 8 and 9 is removed by the thread removing mechanism 69, and the thread removing mechanism 69 only continues to operate until it is certain that the join has been sucked up into the suction nozzle 71. Once the broken weft thread 6A from the weft supply mechanism 3 has been repaired, either manually or automatically, a control signal 73 can be supplied to the control unit 14, which reactivates the weft supply mechanism 3 and restores the supply to the weft supply mechanism 2 with the weft thread 6B which was present in weft supply mechanism 2 before the fault occurred. Preferably, the weft supply mechanism 2 should always be threaded with the weft thread 6B which is most likely to cause faults, as this will enable the number of machine stops to be limited.

The weft supply mechanism 2 does not necessarily have to work only with the same sorts of weft thread as the weft supply mechanisms normally in use. Weft supply mechanism 2 can also be provided with a different type of weft thread 6D from a thread supply 74. A thread break detector 75 can also be mounted along the path of said weft thread 6D. This makes it possible, for example, after a large number of insertions have been made, for a limited number of weft threads 6D to be inserted from weft supply mechanism 2, as a result of a control signal 76 sent by e.g. the weaving machine control which was supplied to the control unit 14 in order to act as a marker between two pieces of cloth. Since the weft thread 6D is only inserted in limited quantities at very large intervals, no separate weft supply mechanism has to be provided for this weft thread 6D.

Clearly, the above-mentioned thread supplies 7 to 12 and 74 can consist of several yarn packages which are connected to each other.

Clearly also, any weft supply mechanism of an existing weaving machine can be used as a reserve mechanism, on condition of course that the weaving machine is equipped with the above-mentioned device 15 and the control unit 14. Of course it is also possible for several weft supply mechanisms to function as reserve mechanisms. Thus for example in the case of a weaving machine which is equipped with six weft supply mechanisms and on which only four different colours are being woven, two weft supply mechanisms can be used as reserve mechanisms. The two weft supply mechanisms placed on standby can for example each be connected to two thread supplies.

The present invention is not limited to the embodiments described by way of example and shown in the figures; on the contrary, such a mechanism for supplying weft threads and the method for supplying the weft threads can be made in different variants while still remaining within the scope of the invention.

What is claimed is:

1. A mechanism for supplying a weft thread to the shed of a weaving machine, comprising:

first weft thread supply means for supplying a first type of weft thread from a first weft thread source to the shed;

second weft thread supply means for supplying a second type of weft thread from a second weft thread source to the shed;

third weft thread supply means for supplying one of a plurality of different types of weft threads from one of a plurality of third weft thread sources to the shed; and weft thread selection means for selecting the type of weft thread to be supplied by said third weft thread supply means, said weft thread selection means including means for selecting one of the plurality of third weft thread sources and providing said third weft thread supply means with thread from the selected third weft thread source.

2. A mechanism as claimed in claim 1, wherein said first and second types of weft threads are different, and one of said different types of weft threads supplied by said third weft thread supply means is of the same type as is normally supplied by one of said first and second weft thread supply means.

3. A mechanism as claimed in claim 2, wherein said weft thread selection means is located between said third weft thread supply means and said plurality of third weft thread sources, and wherein said weft thread selection means includes weft thread joining means for joining a selected type of third weft thread with a weft thread connected to said third weft supply means, and cutting means for stopping provision of a different type of weft thread from a second one of said plurality of third weft thread sources to said weft supply means.

4. A mechanism as claimed in claim 3, further comprising means for automatically threading said third weft supply means, and wherein said selection means further includes a package frame on which said plurality of third weft thread sources are placed and presenting means for presenting selected third weft threads from one of said plurality of sources to said joining means.

5. A mechanism as claimed in claim 4, wherein said presenting means includes a nozzle for each of said plurality of third weft thread sources, said nozzles including means for holding said third weft threads in readiness to be supplied to said third weft thread supply means.

6. A mechanism as claimed in claim 1, further including removing means for partially or completely removing weft threads of an undesired type from said third weft supply means.

7. A mechanism as claimed in claim 6, wherein said third weft supply means comprises a prewinder and at least one main nozzle, and wherein said removing means comprises a suction nozzle and a cutter, said suction nozzle and cutter being located between said prewinder and said main nozzle, and further comprising joining means for joining weft threads also located between said prewinder and main nozzle, and means for causing said suction nozzle, cutter, and joining means to cooperate as follows:

when a weft thread is to be removed from said prewinder in order to supply a different one of said plurality of different weft threads to the shed, said weft thread to be removed is sucked up into the suction nozzle, cut by said cutter such that a part of said weft thread to be removed remains present in the main nozzle, and said weft thread remaining present in said main nozzle is then joined to a new one of said plurality of different weft threads from said prewinder.

8. A mechanism as claimed in claim 6, wherein said removing means comprises a nozzle located on a side of the shed opposite the side of the shed which is adjacent said third weft supply means.

9. A mechanism as claimed in claim 6, wherein said removing means comprises driven thread removing rollers located immediately adjacent the entrance to the shed and which are arranged to operate on at least the weft thread coming from the third weft supply means.

10. A mechanism as claimed in claim 5, wherein said weft thread sources are yarn packages mounted on said package frame, and said presentation means further includes means for rotatably mounting said package frame and said nozzles such that each of said packages and nozzles is rotatable to a position facing said weft supply means.

11. A mechanism as claimed in claim 1, further including a control unit connected to thread detection means for monitoring first and second weft threads which are led to the first and second weft thread supply means, said control unit including control means for controlling the first and second weft supply means during the normal weaving process and, if one of the detection means detects a fault in the supply of thread to one of said first and second weft supply means, for deactivating the corresponding first or second weft supply means and in its place activating the third weft supply means.

12. A method for supplying weft threads to the shed of a weaving machine, comprises the steps of:

normally supplying a first type of weft thread from a first thread supply mechanism to the shed;

normally supplying a second type of weft thread from a second weft supply mechanism to the shed;

holding on standby a third weft supply mechanism which supplies one of a plurality of different types of weft threads, at least two of said different types of weft threads being of the same type as said first and second types of weft threads;

selecting one of said different types of weft threads and providing said third weft thread supply mechanism with said selected type of weft thread;

and switching over to the third weft supply mechanism upon supply of a control signal.

13. A method as claimed in claim 12, wherein said control signal is supplied upon detection of a fault in the normal supply of either of said first and second types of weft threads to the shed.

14. A method as claimed in claim 12, wherein said third weft supply mechanism is used alternately with one of the other weft supply mechanisms in order to ensure the supply of a single type of weft thread during the normal weaving process.

15. A method as claimed in claim 12, wherein said third weft supply mechanism is supplied with the type of weft thread in which faults are most likely to occur.

* * * * *